United States Patent [19]

Bergeson

[11] 3,963,046

[45] June 15, 1976

[54] DISHWASHER

[75] Inventor: Richard P. Bergeson, Newton, Iowa

[73] Assignee: The Maytag Company, Newton, Iowa

[22] Filed: June 5, 1975

[21] Appl. No.: 584,050

Related U.S. Application Data

[63] Continuation-in-part of Ser. No. 467,868, May 8, 1974, Pat. No. 3,906,967.

[52] U.S. Cl. ..... 137/565; 134/188

[51] Int. Cl.[2] ..... B08B 3/02

[58] Field of Search ..... 137/565; 134/186, 188

[56] References Cited

UNITED STATES PATENTS 3,083,717 4/1963 Bear ..... 134/186 X

*Primary Examiner*—Henry T. Klinksiek

*Attorney, Agent, or Firm*—Richard L. Ward

[57] ABSTRACT

A dishwasher construction including a generally concentric pump and covered sump construction disposed on a generally vertical axis and driven by a drive belt that is in turn driven by a motor spaced laterally from the axis of the concentric pump. The pump and sump assembly may be placed into the washing chamber or removed as a unit independent of the motor. The motor may be mounted in a first position relatively adjacent the rear of the dishwasher and generally opposite the access door whereby the weight of the motor opposes the weight of the door in the open position when the dishwasher is used as a freestanding appliance and may be mounted in a second location relatively adjacent the front of the dishwasher whereby the drive motor is easily accessible when the dishwasher is installed as a built-in appliance. The pump and sump assembly is isolated vibrationally from the motor by the combination of a polyurethane drive belt and resilient motor mounts.

13 Claims, 4 Drawing Figures

DISHWASHER

CROSS REFERENCE TO RELATED APPLICATIONS

This application is a continuation-in-part of pending application Ser. No. 467,868 filed May 8, 1974, now U.S. Pat. No. 3,906,967.

BACKGROUND OF THE INVENTION

1. Field of the Invention

This invention relates to a dishwasher and more particularly to a sump and pump construction therefor.

2. Description of the Prior Art

Prior dishwasher art discloses a number of alternate washing systems including a pump in a lower portion of the washing chamber or in fluid communication therewith. U.S. Pat. Nos. 3,310,243 and 3,425,355 for example, disclose representative dishwasher constructions having a generally upstanding axial flow pump disposed in the sump or lower portion of the tub and driven by a concentric motor depending from the washing container. Other United States patents representing a more recent direction in dishwasher construction include the following: U.S. Pat. No. 3,430,861; U.S. Pat. No. 3,491,780; U.S. Pat. No. 3,502,090; and U.S. Pat. No. 3,575,185. These patents disclose various dishwasher constructions including a dual pumping system generally depending from the sump or fluid container and driven by a coaxially disposed motor and further including a filtering system associated with the recirculation pump. A still further system is disclosed in U.S. Pat. No. 3,542,594 and comprises a sump construction depending from the washing container for housing a filtering system and being in fluid communication with a remote pump and motor construction. To remove the pump assemblies as disclosed in the following patents: U.S. Pat. No. 3,242,871; U.S. Pat. No. 3,370,598; and U.S. Pat. No. 3,375,835 it has been necessary to also remove the coaxial motor which necessitates the disconnecting of electrical terminals. In dishwashers including a generally concentric pump and sump system at or below the bottom of the washing chamber, the problem of preventing transmission of vibration has become particularly critical but in prior art has either been ignored as in U.S. Pat. No. 3,179,307 for example, or provision has been made for a large annular cushion or vibration damping resilient member between the tub bottom and the pump housing and motor support, as in U.S. Pat. No. 3,612,714.

SUMMARY OF THE INVENTION

It is an object of the instant invention to provide an improved dishwasher construction.

It is a further object of the instant invention to provide a dishwasher construction having a compact combination sump and pump construction generally depending from the washing chamber.

It is a further object of the instant invention to provide a dishwasher construction having a generally concentric sump and pump construction with the pump being driven by a laterally disposed resiliently mounted motor connected to the pump through a vibration damping resilient drive belt.

It is a further object of the instant invention to provide a dishwasher construction having a combination sump and pump assembly which is removable from within the washing chamber independently of the motor.

It is a further object of the instant invention to provide a dishwasher construction having a combination sump and pump assembly which is disconnectable from the washing chamber without disconnecting the electrical terminals to the motor.

It is a still further object of the instant invention to provide a dishwasher construction including a combination sump and pump assembly including a depending housing defining a sump and further defining concentric recirculation and drain pump cavities in which impellers are rotatable by a laterally disposed motor and interconnecting drive belt.

These objects are achieved in a dishwasher construction including housing means depending from the bottom wall of a washing chamber defining at least one pump cavity and further including rotatable means for effecting a washing of articles in the chamber and a draining of washing fluid therefrom. The sump and pump assembly, including rotatable means, may be preassembled on a bench and may be installed into or removed from the washing chamber as a unit independent of the drive motor and its electrical terminations. The pump is driven by a drive motor laterally spaced from the pump axis and drivingly connected to the pump through the drive belt.

Operation of the device and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views. wherein.

DESCRIPTION OF A PREFERRED EMBODIMENT

Figure 1:
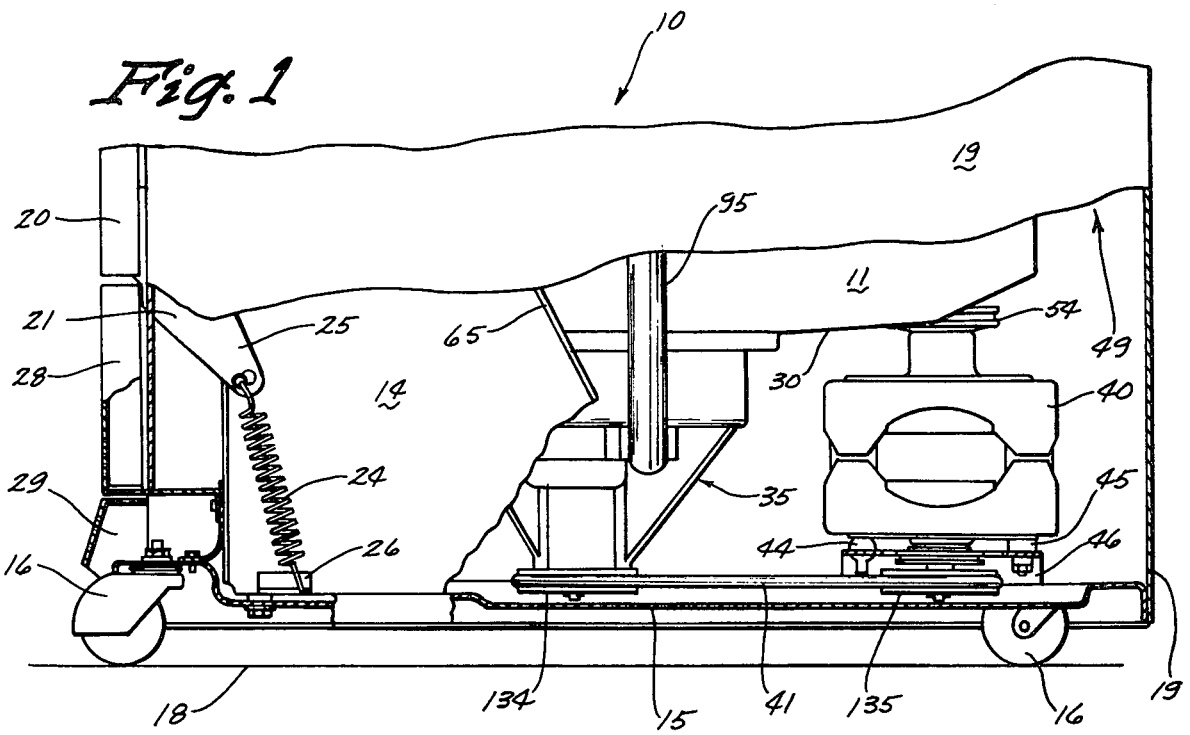
FIG. 1 is a fragmentary view partially broken away and sectioned to show the dishwasher as adapted for operation as a freestanding portable appliance.

Referring to the drawings there is shown in FIG. 1 a dishwasher 10 constructed for operation as a portable freestanding appliance and adapted for optional conversion to a built-in appliance. It has become desirable to provide a household dishwashing apparatus that may be used, initially at least, as a freestanding portable appliance and then, at a later date, be converted for use as a built-in appliance. Such a convertible dishwasher may be used as a freestanding portable appliance where it is not feasible or desirable to install the dishwasher as a built-in appliance. The same appliance, if convertible, can later be installed as a built-in when it becomes possible. It is recognized that these two different modes of operation require different structure as particularly related to cabinetry, overall stability, and liquid control. The dishwasher 10 disclosed in this application is convertible and provides distinct advantages in operation and conversion as compared to prior art devices.

Referring specifically to FIG. 1, there is shown a fragmentary lower portion of the dishwasher 10 as constructed for freestanding portable use. The dishwasher 10 includes a tub or fluid container 11 of which only a lower portion is shown and to which is attached a pair of side supports 14 extending downwardly and being fixed at the lower end to a base member 15. The base member 15 is mounted on a plurality of casters 16 which engage a horizontal surface 18 for movably supporting the dishwasher 10 thereon.

A cabinet or enclosure 19, attached along the lower edge to the base member 15, extends upwardly along the sides and rear of the appliance. A door 20 is mounted on the front of the dishwasher and is supported on the side supports 14 through a pair of hinges 21. A spring 24 is connected between the end of the high arm 25 and a bracket 26 fixed to the side support 14. The spring 24, at least partially, counterbalances the weight of the door 20 as it moves to the open position. Disposed below the door 20 is a removable access panel 28 providing accessibility into the compartment below the liquid container 11. A caster cover 29 is disposed below the access panel 28 for at least partially covering the pair of front casters 16.

Figure 3:
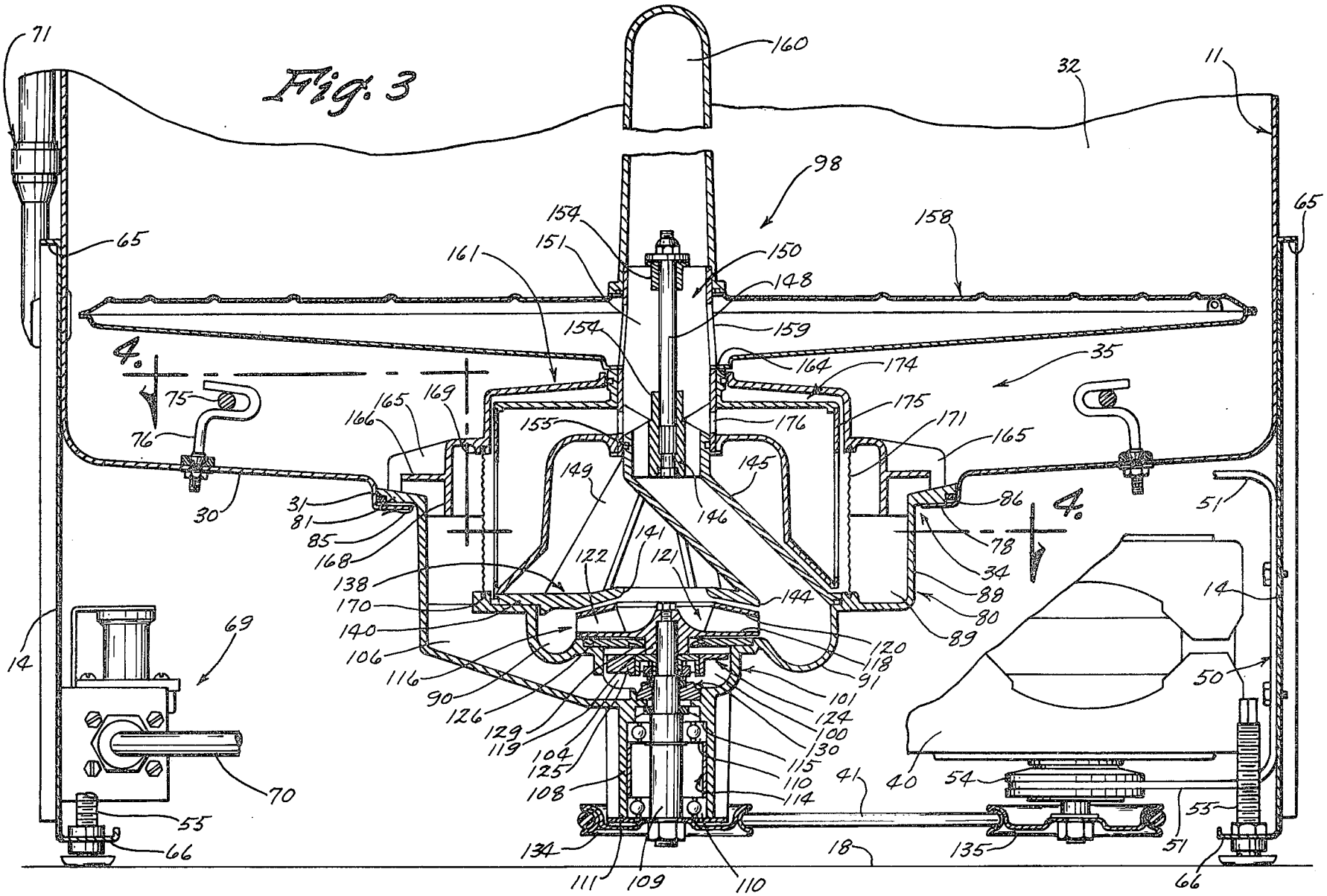
FIG. 3 is a cross-section view of the dishwasher as generally shown in FIG. 2 and comprising, primarily, a vertical section of the combination sump and pump construction.

The fluid container or tub 11 defines, as best shown in FIG. 3, a chamber 32 having a bottom wall 30 which includes a generally central recess 31 and opening 34 in which is positioned a combination sump and pump assembly 35 including a recirculating pump operable for effecting a recirculation of fluid to the washing chamber 32 and a drain pump for removing washing fluid from the chamber 32, as will be described in detail hereinafter. As shown in FIG. 1, the pumps are connected to the rearwardly disposed drive motor 40 by a stretch belt 41.

The fractional horsepower, bidirectional drive motor 40 is mounted on the base 15 of the freestanding dishwasher of FIG. 1 through resilient spaces 44 and 45 and auxiliary bracket 46. It is particularly noted that the placement of the motor 40 toward the rear of the appliance provides a gravity force tending to counterbalance forces applied to the door 20 in the open position to assist in the prevention of tipping of the portable appliance. The location of the motor 40 is further shown by the broken line outline 48 in FIG. 4.

As a measurement of the stability or resistance to tipping of a portable dishwasher when a force is applied to a door in the open position, one standard accepted in the industry requires that the machine not tip when a 50-pound load is applied at the outer edge of the open door with no dishes or water in the dishwasher. Prior art patents disclose a number of auxiliary devices which were necessary to prevent tipping including leg braces, support levers, and breakaway doors, for example. The placement of the motor, which weighs approximately 12-1/2 pounds, toward the rear of the appliance as shown in FIG. 1, however, advantageously distributes the weight of the dishwasher to obviate the need for auxiliary bracing or breakaway devices.

A top cover or top panel for the portable appliance is provided but is not shown in FIG. 1. Similarly, the portable appliance is provided with a faucet adapter assembly to connect the dishwasher to the water supply line for filling the appliance and to position the drain conduit for conducting washing fluid from the appliance to an external drain. The faucet adapter assembly and connecting hoses, though not shown in FIG. 1, are at least partially housed in the rear compartment 49 between the tub 11 and the rear wall of the cabinet 19.

Figure 2:
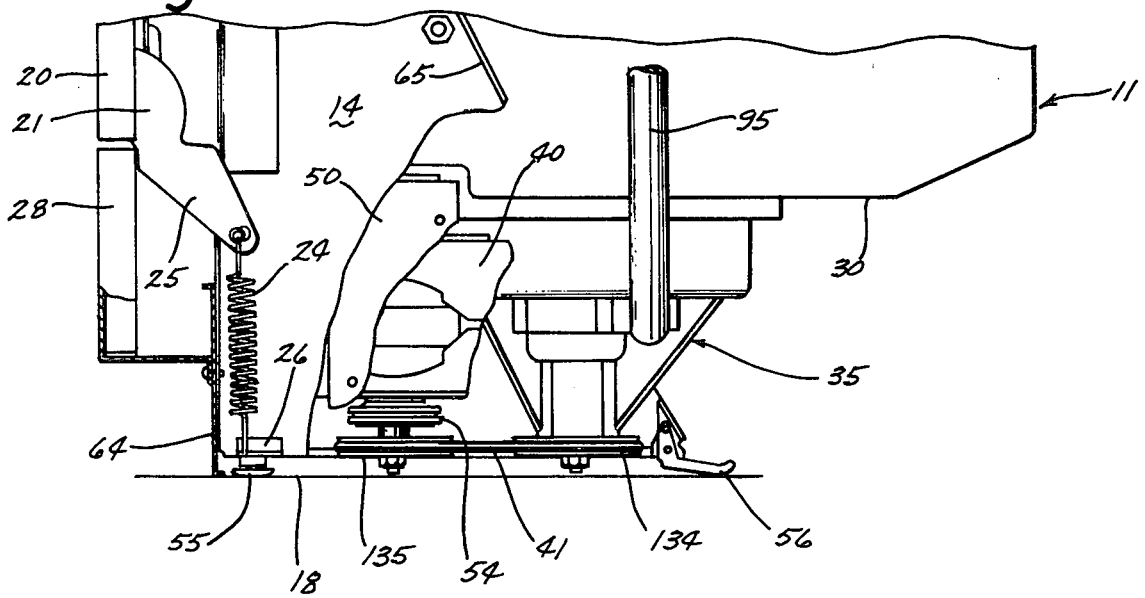
FIG. 2 is a view similar to FIG. 1 showing the dishwasher as modified for operation as a built-in appliance.

Referring to FIG. 2 the same basic dishwashing apparatus is shown converted for installation as a built-in appliance. The basic dishwashing apparatus includes the liquid container 11 defining a washing chamber and supported on the pair of side panels 14. The combination sump and pump assembly 35 remains the same as shown in FIG. 1. The hinged door 20, the mounting thereof, and the access panel 28 are also the same as in FIG. 1. The spring 24 is depicted in an alternate position to show the adjustable feature thereof.

A number of components, however, have been removed in the conversion between the freestanding appliance and the built-in appliance. Some of these components are simply unnecessary in the built-in installation. It is clear that the enclosure cabinet 19 has been removed as has been the base 15 and casters 16 connected thereto. The caster cover 29 and top cover (not shown) become unnecessary and are removed. The faucet connector assembly for connecting the water supply line and the drain hose to a suitable sink has been removed and replaced with more permanently connected conduits for the built-in installation.

Figure 4:
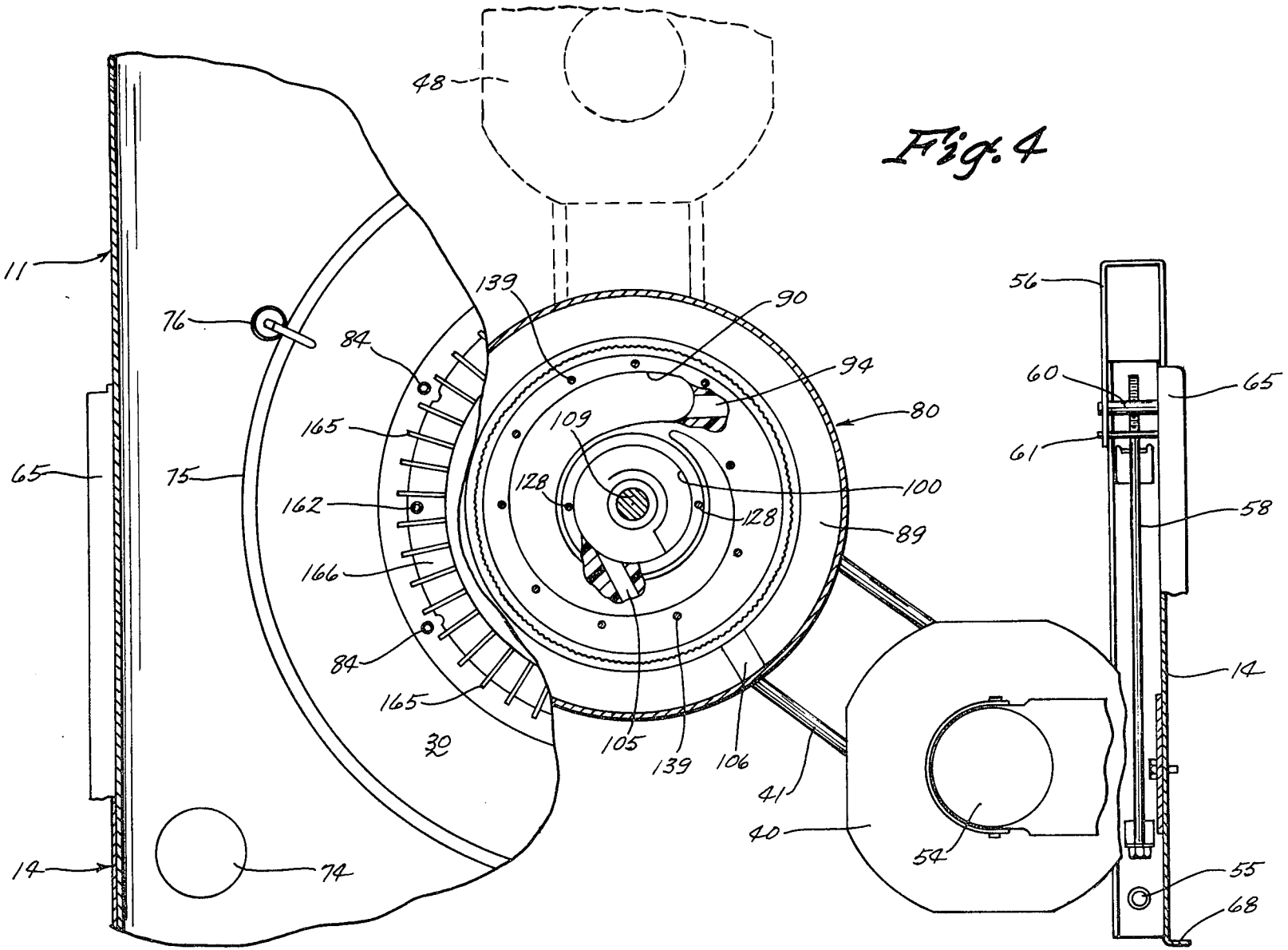
FIG. 4 is a fragmentary plan view of the dishwasher apparatus of FIGS. 2 and 3 as partially sectioned and taken generally along lines 4—4 of FIG. 3.

It is clear from FIG. 2 and also indicated in FIG. 4 that the motor 40 has been moved from the rearward position to a position near the front right corner so as to be conveniently accessible for serviceability thereof since stability or tipping of the built-in appliance is not a major factor. The bracket 46 and resilient spacers 44, 45 for supporting the motor on the base 15 at the rear of the machine have been removed and replaced with an alternate bracket 50 attached, as in FIG. 3, to one of the side supports 14. The bracket 50 includes a pair of horizontally extending flanges 51 which are clamped to rings 54 resiliently fixed to the ends of the motor 40. The drive motor 40 is therefore optionally mounted in either of two positions. The distance between the drive motor 40 and the center line of the sump and pump assembly 35 is the same in each construction and thus the same drive belt 41 may be used for both motor locations.

The appliance of FIG. 2 is supported on a plurality of floor-engaging members including a pair of screw-in feet 55 at the front of the machine which are easily adjustable at the front of the machine and also including a pair of pivotally mounted feet 56 at the rear of the side supports 14. The pivoted feet 56 are also adjustable at the front of the machine through a pair of hex-headed elongated members 58 extending, as in FIG. 4, from the front of the machine to the rear of the machine into threaded engagement with a pivot bar 60 for moving the floor engaging foot 56 about pivot pin 61 as more particularly disclosed and claimed in U.S. Pat. No. 3,750,989 issued Aug. 7, 1973, to Richard P. Bergeson and assigned to the assignee of the instant invention.

A toeboard panel 64 is added to the dishwasher below the access panel 28 to enclose the lowermost portion of the front of the machine upon installation as a built-in appliance. The additional components necessary to convert the dishwasher from a portable freestanding device to a built-in appliance, such as motor bracket 50, supporting feet 55 and 56, and toeboard 64 as described above, would be available as acessories.

In FIG. 3 there is shown a generally vertical cross section of the lower portion of the washing chamber 32 and the combination sump and pump assembly 35. As previously indicated, the tub 11 is supported by a pair of side legs or supports 14 having reinforcing flanges 65 and 66 extending along the slanting top and along the bottom, respectively, as best seen in FIG. 3 and flange 68 along the front as best shown in FIG. 4. The bottom flange 66 provide means for receiving the floor engaging member, such as the two screw-in legs 55 positioned at the front of the machine. These legs 55 may be adjusted to vary the height of the dishwasher within the provided opening when installed as a built-in appliance.

FIG. 3 also shows a portion of the water inlet system including a valve 69 mounted on the side support 14. A conduit 70 from the valve 69 extends toward the rear of the machine and to the outside of the tub 11 and connects with the inlet system 71 for directing liquid into the washing chamber 32. The inlet system 71 along the side of the tub 11 includes the necessary air gap. A float device 74, as in FIG. 4, may be provided for control of the water inlet system.

A heater, as shown in FIGS. 3 and 4, is provided within the washing chamber 32 for raising the temperature therein and includes an elongated arcuate element 75 supported by a plurality of supports 76 attached to the fluid container bottom wall 30.

As previously indicated, the bottom wall 30 includes a generally centrally located recess 31 having a flange 78 defining an opening 34 for receiving the combination sump and pump assembly 35. The main sump-pump housing 80 is generally annular and is assembled into the opening 34 in the bottom wall 30 from inside the washing chamber 32 so that the upper flange 81 of the housing 80 engages the recessed flange 78 of the bottom wall 30. The flange 81 is connected to the bottom wall recessed flange 78 with a plurality of threaded members 84, such as in FIG. 4 and retainer clips 85, as in FIG. 3. An annular seal 86 is disposed at the joint to prevent liquid leakage from the washing chamber 32.

A first portion 88 of the housing 80 depending from the bottom wall 30 defines a generally annular sump 89 communicating and facing generally upwardly toward the washing chamber 32 as shown best in FIGS. 3 and 4. Disposed generally below the sump 89 is a first pump cavity 90 defined by a second housing portion 91 and having a volute form for receiving fluid from the sump 89 and through which the fluid is pumped to the fluid distribution system for effecting washing of articles in the washing chamber 32.

Referring to FIG. 4, inner portions of the sump and pump assembly 35 including the recirculation pump cavity 90 are shown by removing a number of components of the assembly. Also referring to FIG. 4, there is shown outlet 94 extending from the end of the recirculation pump cavity 90 for connection with the upwardly extending conduit 95 as shown in FIGS. 1 and 2 which carries a portion of the fluid from the recirculation pump cavity 90 to an upper spray arm (not shown). The recirculation pump cavity 90 is also connected to the lower fluid distribution system 98 as shown in FIG. 3 and as will be more fully explained hereinafter.

Disposed below the recirculation pump cavity 90 is a radially smaller and generally annular drain pump cavity 100 defined by a third housing portion 101 for accommodating flow of fluids from the dishwasher sump 89 to an external drain. The cavity 100 includes an inlet 104, as in FIG. 3, and an outlet 105, as in FIG. 4. The inlet 104 communicates with the sump 89 through a conduit 106 defined by the housing 80. Also formed as a part of the main housing 80 is a depending sleeve 108 for supporting a pump shaft 109 through a pair of bearings 110 which are retained within the sleeve-like housing 108 by end plate 111, spacer sleeve 114, and the shoulder 115.

A closed vane recirculation impeller 116 is mounted on the shaft 109 for operation within the recirculation pump cavity 90. The recirculation impeller 116 includes a disk-like lower base 118 connected to the hub 119 and also includes an annular cover 120 defining a central opening 121 into a plurality of arcuate vanes 122. A drain pump impeller 124 is disposed within the drain pump cavity 100 and includes a plurality of downwardly extending open vanes 125.

A divider 126 is disposed below the recirculation pump impeller 116 to effectively divide the recirculation and drain pump cavities 90 and 100. The divider 126 is fixed to the housing 80 by a pair of screws 128, as in FIG. 4, and includes an inner lip 129 juxtaposed to the hub 119 of the recirculation impeller 116. The divider 126 functions as a proximity seal and flow regulator as described in U.S. Pat. No. 3,542,496 issued Nov. 24, 1970 to Bergeson et al and assigned to the assignee of the instant invention. Disposed below the drain pump impeller is a liquid seal arrangement 130 including a liquid slinger to prevent water from entering the bearings 110. A pulley 134 is secured to the lower end of the pump shaft 109 to effect rotation of the pump shaft 109 and the pair of impellers 116, 124.

The pump pulley 134 is connected to the motor pulley 135 by a round polyurethane drive belt 41. The drive belt 41, being a resilient stretch belt, serves to dampen motor vibrations in combination with the resilient rings 54. This combination obviates the damping-sealing ring commonly necessary when the motor is coaxially mounted to the pump unit. The use of the round stretch drive belt 41 enables the flange 81 of the pump housing 80 and the flange 78 of the tub bottom to contact each other without vibrational problems.

The motor 40 is operable in first and second directions for driving the pump shaft 109 to effect, in one direction of rotation, a recirculation of fluid to said washing chamber 32 while maintaining a relatively small positive pressure head at the outlet 105 of the drain pump cavity 100 and to effect, in the opposite direction, a substantial increase in output pressure of the drain pump for draining fluid from the washing chamber 32 and sump 89 while maintaining recirculation of fluid by the recirculation pump, but at a significantly lower rate, as long as sufficient fluid remains in the sump 89.

An intermediate or internal housing 138 is disposed within the sump as in FIG. 3. The intermediate housing 138 has been removed from the assembly in FIG. 4 but is attached to the main housing 80 by a plurality of screws 139 along the recirculation pump cavity 90 as shown in FIG. 4. The intermediate housing 138 comprises a cover 140 for the recirculation pump and defines an axial inlet 141 into the recirculation pump cavity 90. The intermediate housing 138 also defines an outlet 144 from the recirculation pump at the end of the volute cavity 90 and forms an upwardly extending conduit or tube 145 from the outlet 144 for connection with the recirculating means 98 disposed in the lower portion of washing chamber 32. The upper end of the manifold or tube 145 includes an internal hub 146 for fixedly supporting a shaft 148 on which a spray device is mounted and as will be described hereinbelow. The intermediate housing 138 further includes a plurality of generally upwardly extending ribs 149 for supporting the upper end of the tube 145 and the shaft 148 fixed therein.

The fluid distribution system 98 includes an upstanding fluid conduit or fluid distribution hub 150 having a plurality of internal ribs 151 supporting a pair of bearings 154 for rotational support of the hub 150 on the shaft 148. The lower end of the conduit or hub 150 engages a seal 155 disposed in a groove of the upper portion of the upwardly extending tube 145 and interlocked with the tube 145 to prevent rotation of the seal 155. The main spray arm 158 is mounted on the upstanding fluid conduit or hub 150 for rotation therewith. Openings 159 in opposite sides of the fluid conduit or hub 150 at the spray arm 158 accommodate the fluid flow from the recirculation pump cavity 90 to the outwardly extending spray arm 158. A nozzle 160 extends upwardly from the end of the fluid conduit or hub 150 for distributing washing fluid up into the intermediate regions of the dishwashing chamber 32. The nozzle 160 is fixed to the end of the fluid conduit or hub 150 for rotation therewith and retaining the spray arm 158 on the conduit or hub 150.

An upper housing portion or cover 161 is attached to the main housing 80 along the upper annular flange 81 of the main housing 80 at screws 162 as in FIG. 4. The cover 161 is substantially imperforate and includes a generally central opening 164 for accommodating the upwardly extending fluid distribution conduit 150. A seal is disposed at the opening 164. Along the periphery of the cover as best shown in FIGS. 3 and 4 are a plurality of generally upstanding radiating ribs 165 that extend radially beyond the outer horizontal flange 166 of the cover. The vanes or ribs 165 are radially spaced around the periphery of the cover 161 to define a plurality of tunnels having, because of downwardly extending vertical flange 168, a generally 90° turn between the washing chamber 32 and the sump 89.

The outer periphery of the cover 161 thus defines a strainer between the washing chamber 32 and the sump 89 to prevent flow of large particles from the washing chamber 32 into the sump 89. The spacing of the vanes 165, the radial extension of the vanes 165 relative to the horizontal flange 166, and the 90° turn defined by the horizontal flange 166 and the downwardly extending vertical flange 168 prevent flow from the washing chamber 32 of particles or articles exceeding predetermined dimensional characteristics. This flow control device or strainer thus prevents articles from getting into the drain pump cavity 100 and blocking or damaging the impeller 124 thereof.

A lower surface of the cover 161 defines a downwardly facing annular groove 169 generally aligned with a similar upwardly facing annular groove 170 in the lower portion of the sump 89. These grooves 169, 170 receive the end rings of a generally annular and cylindrical fine mesh filter screen 171 for support within the sump 89. The filter screen 171 thus effectively divides the sump 89 into first and second portions with the inlet of the conduit 106 to the drain pump cavity 100 being outside or upstream from the filter 171, while the inlet 141 to the recirculation pump cavity 90 is radially within or downstream relative to the filter 171.

The disposition of the filter 171 within the sump 89 between the inlets of the drain and recirculation pumps effectively establishes two fluid paths from the washing chamber 32. A first fluid path extends from the washing chamber 32 through the strainer, the outer sump portion, and the filter screen 171 into the inner sump portion for conduction to the inlet 141 of the recirculation pump. The fluid is then pumped to the fluid distribtuion means. A second fluid path extends from the washing chamber 32 through the strainer to the outer sump portion and from the outer sump portion through the housing-defined fluid duct 106 to the inlet 104 of the drain pump cavity 100. From the drain pump cavity 100 the fluid is pumped to an external drain through the drain pump outlet 105 when the pump is driven in the predetermined "drain" direction.

Disposed within the annular filter screen 171 is an auxiliary spray device for effecting a cleaning or backflushing of the filter screen. The device includes an arm 174 comprising two depending spray tubes 175 having an elongated slit along the surface adjacent to the screen 171 for spraying liquid onto the downstream side of the screen. The arm 174 is fixed to and rotatable with the upstanding fluid conduit or hub 150. Fluid flows from the upstanding fluid conduit or hub 150 into the spray arm 174 through the openings 176 aligned with the spray arm 174.

Thus, with the motor 40 operating in a first direction to drive the pump shaft 109 and recirculation impeller 116 in a clockwise direction, as viewed in FIG. 4, the first fluid flow path is established and a high pressure recirculation of fluid to the washing chamber 32 is effected. In this first direction of rotatin the drain pump is operable for maintaining a generally static fluid pressure in the drain line to prevent flow of fluid from the washing chamber while preventing backflow of fluid from the drain line into the sump 89. In the opposite direction of rotation the recirculation pump is still operable for effecting fluid flow into the fluid distribtuion conduit or hub 150 at a reduced rate, but the drain pump becomes operable for effecting a substantial increase in pumping pressure at the drain pump outlet 105 to establish the second fluid flow path and effect a relatively rapid draining of fluid from the washing chamber.

The output of the recirculation pump is effectively divided between the upper spray arm (not shown), the spray nozzle 160, the main wash arm 158, and the auxiliary filter cleaning spray arm 174. With the recirculation pump operating in the clockwise direction as in FIG. 4 to produce an output of approximately 35 gallons per minute, the relative distribution of fluid from the outlet is as follows: top spray arm 10.1 gpm; spray nozzle 9.6 gpm; lower spray arm 9.6 gpm; and backwash auxiliary spray arm 5.7 gpm.

One feature of the construction of the instant invention not previously discussed herein relates to the optional preassembly of the combination sump and pump construction. The entire assembly 35, including the main housing 80, the cover 161, the internal housing 138, and the upstanding fluid distribution conduit or hub 150 as well as all of the internal operating components may be preassembled on a bench stand. The completed assembly 35 may then be inspected and tested prior to installation in the washing chamber bottom wall 30.

The combination sump and pump assembly 35 may also be referred to as the washing means for the dishwasher. Optionally, the washing means may be considered as including the lower fluid recirculation means 98 or excluding the sump portion which in an alternate embodiment might be provided as part of the cabinet bottom wall.

Thus the combination sump and pump assembly and the lower fluid recirculation means, comprising the washing means in the embodiment shown, may be preassembled and installed in the opening as a unitary assembly and may similarly be removed as an assembly for servicing or replacement.

Since the sump and pump assembly is mounted in the dishwasher independently of the motor, the washing means may be removed from the dishwasher, through the washing chamber, without physically removing the motor or without disconnecting the electrical connections to the motor. Servicing of the dishwasher is thus facilitated without removing the apparatus from its installed position and is made somewhat safer and more convenient.

To remove the washing means from the dishwasher it is only necessary to remove the drive belt 41 and disconnect two hoses from below the bottom wall. The threaded members 84 may be removed from within the washing chamber and the entire washing means including the sump and pump assembly lifted up into the washing chamber and out of the dishwasher for servicing.

Alternatively, the construction also permits the entire unit to be serviced by removing individual components or subassemblies including removal of the lower housing from the bottom wall without removing the motor or without disconnecting the electrical supply to the motor.

The present construction thus provides an improved dishwasher apparatus achieving a unique combination of the pumping and filtering apparatus with the dishwasher sump. The combined construction permits the achievement of all the advantages of the dual pump and filtering system while eliminating a number of components heretofore required. In addition to operational advantages, the present construction achieves improved accessibility and serviceability of the wash system components.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. In a dishwasher apparatus, the combination comprising: means defining a washing chamber and including a bottom wall defining a generally central opening; washing means disposed at least partially in said opening and including a housing defining at least one pump cavity and further including rotatable means for effecting a washing of articles in said chamber and a draining of washing fluid therefrom; connector means accessible from said washing chamber for connecting said washing means to said bottom wall, said washing means being constructed for assembly into the opening in said bottom wall from within said washing chamber and removably connected to said bottom wall by said connector means; a drive motor disposed below said bottom wall and mounted to said dishwasher apparatus independently of said washing means; and disconnectable drive means for drivingly connecting said drive motor to said washing means, said washing means being disconnectable from said bottom wall and removable from said opening into said washing chamber independently of said drive motor.

2. A dishwasher apparatus as defined in claim 1 wherein said bottom wall includes a flange around said opening and said housing includes an outwardly extending flange overlying said bottom wall flange and wherein said connector means comprises a plurality of threaded fasteners spaced uniformly around said outwardly extending flange on said housing of said washing means for retaining said washing means in said central opening of said bottom wall.

3. A dishwasher apparatus as defined in claim 1 wherein said removable washing means is preassembled prior to connection to said bottom wall.

4. A dishwasher apparatus as defined in claim 1 wherein said removable washing means is removable as a unitary assembly.

5. In a dishwasher apparatus, the combination comprising: means defining a washing chamber and including a bottom wall defining a generally central opening; washing means disposed at least partially in said opening and including a housing defining at least one pump cavity and further including rotatable means for effecting a washing of articles in said chamber and a draining of washing fluid therefrom; connector means accessible from said washing chamber for connecting said washing means to said bottom wall, said washing means being constructed for assembly into the opening in said bottom wall from within said washing chamber and removably connected to said bottom wall by said connector means; a drive motor spaced laterally of said opening below said bottom wall and mounted to said dishwasher apparatus independently of said washing means; and means for drivingly connecting said motor to said washing means, said washing means being disconnectable from said bottom wall and removable as a unitary assembly from said opening into said washing chamber independently of said motor.

6. A dishwasher apparatus as defined in claim 5 wherein said bottom wall includes a flange portion around said opening for supporting an upper flange portion of said housing.

7. A dishwasher apparatus as defined in claim 6 wherein said removable washing means includes seal means disposed between said flange portions for effectively sealing said centrally located opening to prevent leakage of said washing fluid from said washing chamber.

8. In a dishwasher apparatus, the combination comprising: means defining a washing chamber and including a bottom wall defining a generally central opening; washing means preassembled as a unitary structure and including a housing defining at least one pump cavity and further including independently means for effecting a washing of articles in said chamber and a draining of washing fluid therefrom, said preassembled washing means being insertable into the opening in said bottom wall from within said washing chamber; connector means accessible from said washing chamber for removably connecting said washing means to said bottom wall; a drive motor disposed below said bottom wall and mounted to said dishwasher apparatus independently of said washing means; and means for drivingly connecting said motor to said washing means, said washing means being disconnectable from said bottom wall and removable from said opening into said washing chamber independently of said motor.

9. A dishwasher apparatus as defined in claim 8 wherein said preassembled washing means is disconnectable from said bottom wall as a unitary structure.

10. In a dishwasher apparatus, the combination comprising: means defining a washing chamber and including a bottom wall defining a generally central opening; washing means preassembled as a unitary structure and including a housing defining at least one pump cavity and further including rotatable means for effecting a washing of articles in said chamber and a draining of washing fluid therefrom, said preassembled washing means being insertable into the opening in said bottom wall from within said washing chamber; connector means accessible from said washing chamber for removably connecting said washing means to said bottom wall; a drive motor disposed below said bottom wall and mounted to said dishwasher apparatus independently of said washing means; electrical supply means connected to said drive motor; and means for drivingly connecting said motor to said washing means, said washing means being disconnectable from said bottom wall and removable from said opening into said washing chamber independently of said motor and said electrical supply means.

11. In a dishwasher apparatus, the combination comprising: means defining a washing chamber and including a bottom wall having a flange defining a generally central opening; washing means disposed at least partially in said opening and including a housing defining at least one pump cavity and further including rotatable means for effecting a washing of articles in said chamber and a draining of washing fluid therefrom, said housing including a flange conforming generally to said bottom wall flange and being in contact therewith; connector means for rigidly connecting said washing means to said bottom wall; liquid seal means adjacent to the generally mating surfaces of said bottom wall flange and said housing flange for preventing leakage of liquid from said washing chamber; a drive motor disposed below said bottom wall and resiliently mounted to said dishwasher apparatus independently of said washing means; and vibration damping resilient drive means for drivingly connecting said drive motor to said washing means.

12. In a dishwasher apparatus as defined in claim 11 wherein said resilient drive means comprises a round stretch belt of polyurethane material.

13. In a dishwasher apparatus, the combination comprising: means defining a washing chamber and including a bottom wall having a flange defining a generally central opening; washing means disposed at least partially in said opening and including a housing defining at least one pump cavity and further including rotatable means for effecting a washing of articles in said chamber and a draining of washing fluid therefrom, said housing including a flange conforming generally to said bottom wall flange and being in contact therewith; connector means accessible from said washing chamber for rigidly connecting said washing means to said bottom wall; liquid seal means adjacent the generally mating surfaces of said bottom wall flange and said housing flange for preventing leakage from said washing chamber, said washing means being constructed for assembly into the opening in said bottom wall from within said washing chamber and removably connected to said bottom wall by said connector means; a drive motor disposed below said bottom wall and resiliently mounted to said dishwasher apparatus independently of said washing means; and disconnectable vibration damping resilient drive means for drivingly connecting said drive motor to said washing means, said washing means being disconnectable from said bottom wall and removable from said opening into said washing chamber independently of said drive motor.

* * * * *

UNITED STATES PATENT AND TRADEMARK OFFICE

CERTIFICATE OF CORRECTION

PATENT NO. : 3,963,046

DATED : June 15, 1976

INVENTOR(S) : Richard P. Bergeson

It is certified that error appears in the above-identified patent and that said Letters Patent are hereby corrected as shown below:

| | |
|---|---|
| Col. 3, line 19 | "high" should be -- hinge -- |
| Col. 6, line 65 | "recirculating" should be -- recirculation -- |
| Col. 8, line 31 | "rotatin" should be -- rotation -- |
| Claim 8, line 57 | "independently" should be -- rotatable -- |

Signed and Sealed this

Thirty-first Day of August 1976

*Attest:*

RUTH C. MASON
*Attesting Officer*

C. MARSHALL DANN
*Commissioner of Patents and Trademarks*